United States Patent [19]

Wu

[11] Patent Number: 4,947,670

[45] Date of Patent: Aug. 14, 1990

[54] UNIVERSAL AUTOMATIC SPRING-MAKING MACHINE

[76] Inventor: Chin-Tu Wu, P.O. Box 10160, Taipei, Taiwan

[21] Appl. No.: 432,884

[22] Filed: Nov. 7, 1989

[51] Int. Cl.[5] ..... B21F 3/027; B21F 3/10; B21F 11/00; B21F 35/02

[52] U.S. Cl. ..... 72/130; 72/137; 72/138; 72/140

[58] Field of Search ..... 72/130, 131, 132, 135, 72/137, 138, 140, 145

[56] References Cited

U.S. PATENT DOCUMENTS

| | | | |
|---|---|---|---|
| 873,430 | 12/1907 | Harter | 72/14 |
| 2,134,469 | 10/1938 | Bergevin | 72/137 X |
| 4,112,721 | 9/1978 | Takase et al. | 72/132 X |
| 4,227,392 | 10/1980 | Itaya | 72/137 |
| 4,296,621 | 10/1981 | Ohdai et al. | 72/130 |
| 4,680,950 | 7/1987 | Ohdai et al. | 72/130 |
| 4,873,854 | 10/1989 | Russell et al. | 72/132 X |

FOREIGN PATENT DOCUMENTS

| | | | |
|---|---|---|---|
| 2006876 | 10/1971 | Fed. Rep. of Germany | 72/138 |

*Primary Examiner*—E. Michael Combs

[57] ABSTRACT

A spring-making machine includes a plurality of forming tools reciprocatively sliding in a plurality of tool guides radially disposed on a panel so that a spring wire led through a central chuck of the machine will be automatically formed as diversified shapes or orientations of spring products by the forming tools for conveniently and efficiently making springs.

4 Claims, 6 Drawing Sheets

UNIVERSAL AUTOMATIC SPRING-MAKING MACHINE

BACKGROUND OF THE INVENTION

For mass production of conventional springs, special-purpose machinery has been developed in which the spring wire is pulled off a reel by means of rollers and fed into the machine. It passes over a stationary mandrel and strikes a deflector plate, which makes it curl itself around the mandrel. At a predetermined point in the machine cycle, the wire feed stops to allow the end of the spring to be cut off. Attachments should be provided for forming the ends of the wire into hook shapes, or bend them or grind them so that they are square at a 90 degrees angle to the length of the spring. It is impossible to produce a spring having diversified orientations such as multiple axes of X axis, Y axis and Z axis. For adjusting the orientations or spring shapes, the conventional spring-making machine is difficultly operated and inconveniently processed.

The present inventor has found the drawbacks of a conventional spring-making machine and invented the present universal automatic spring-making machine.

SUMMARY OF THE INVENTION

The object of the present invention is to provide a spring-making machine having a plurality of forming tools reciprocatively sliding in a plurality of tool guiding means radially disposed on a panel so that a spring wire led through a central chuck will be automatically formed as diversified shapes or orientations of spring products by the forming tools for conveniently and efficiently making springs.

DETAILED DESCRIPTION

Figure 6:
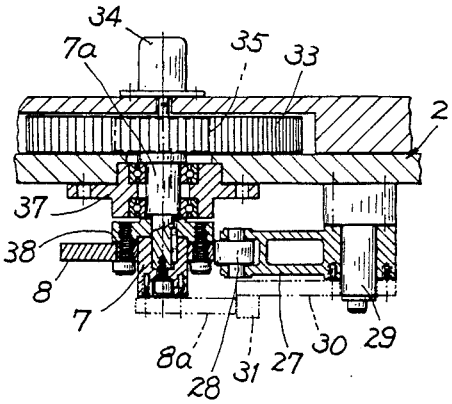
FIG. 6 is a partial sectional drawing of the gear box and the crank means of the present invention.
Figure 8:
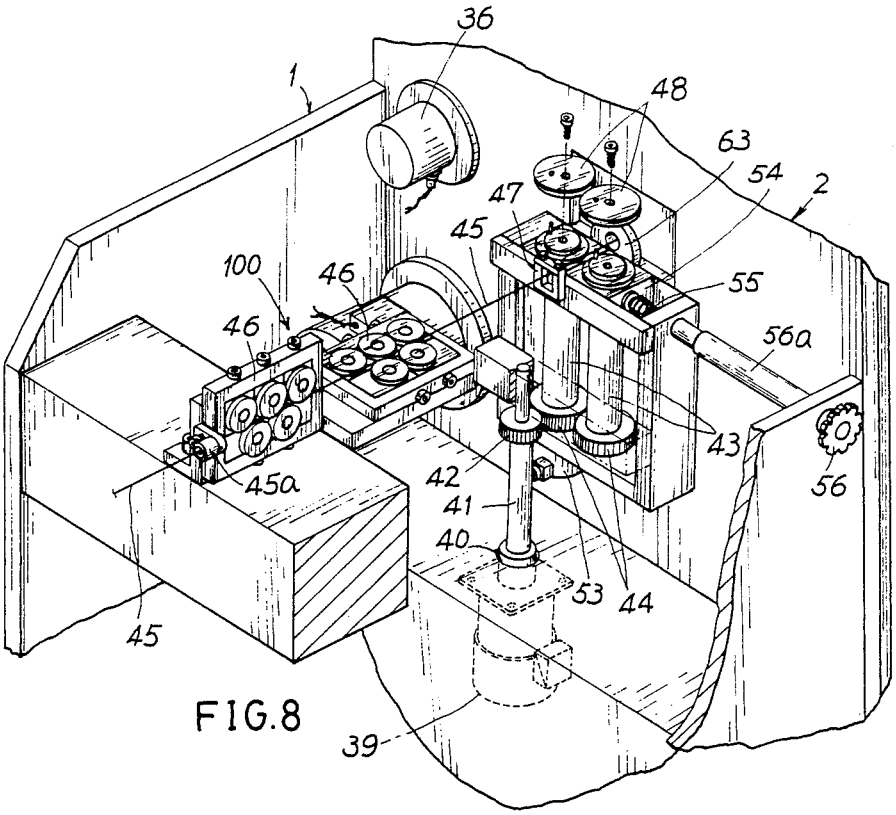
FIG. 8 shows a spring-wire feeding system of the present invention.
Figure 5:
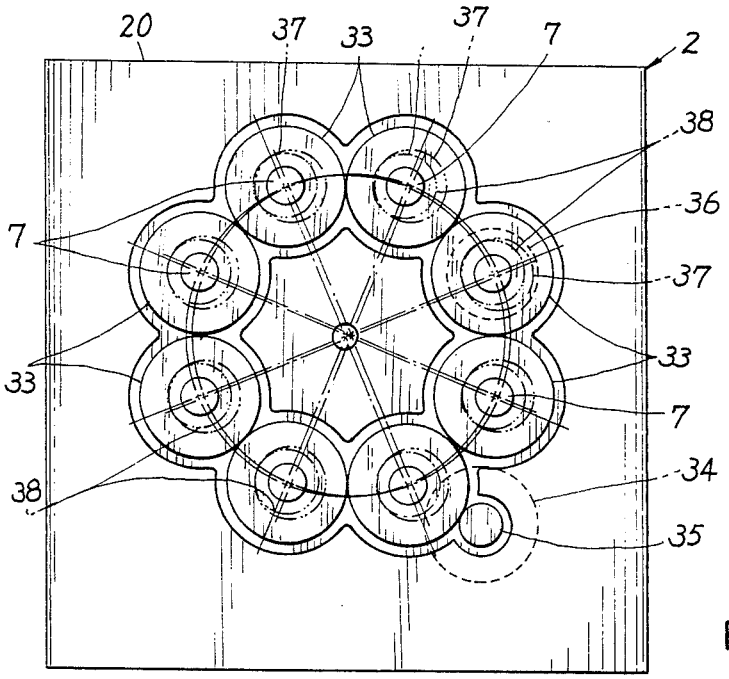
FIG. 5 is an illustration showing the arrangement of a gear transmission system of the present invention.
Figure 15:
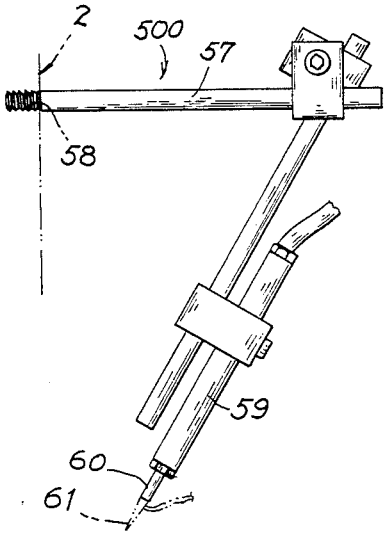
FIG. 15 shows an auxiliary pneumatic controller of the present invention.

As shown in the figures, the present invention comprises: a frame 1 for mounting a gear box transmission system 2 as shown in FIGS. 5 and 6 on the frame 1, a plurality sets of tool guiding means 3 (such as 8 sets) radially disposed on a panel of the gear box 2, a spring-wire feeding system 100 as shown in FIG. 8 positioned before the gear box 2, a microprocessor controller 4 and an auxiliary pneumatic controller 500 as shown in FIG. 15. A plurality of different forming tools 6 and forming-tool holders 5 may be selectively mounted on the plural sets of tool guiding means 3. A plurality of different cams 8 may also be selectively mounted on the gear box transmission system 2 for producing differently shaped springs as controlled by the microprocessor controller 4.

Figure 1:
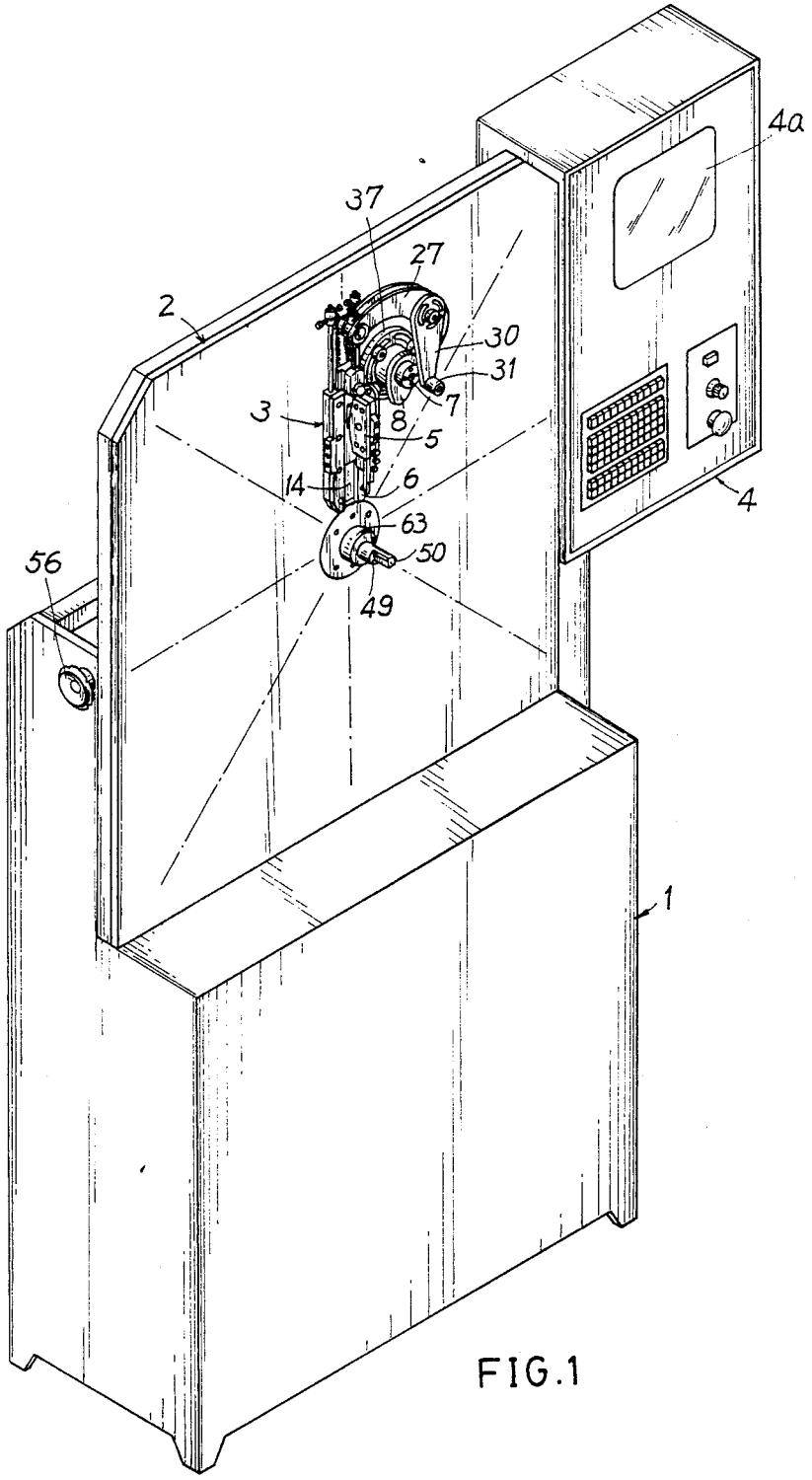
FIG. 1 is an illustration of a perspective view of the present invention.
Figure 2:
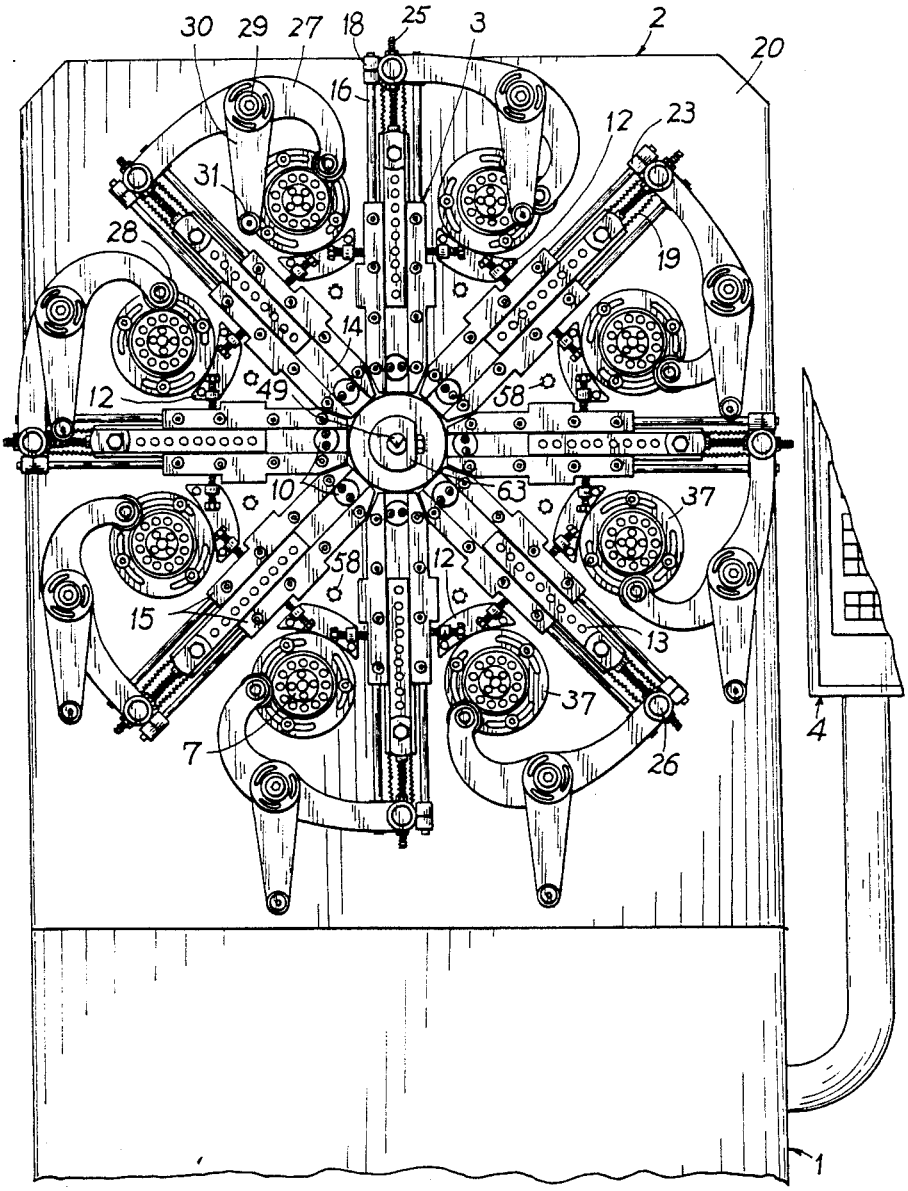
FIG. 2 shows the distribution of eight sets of tool guiding means on a panel of the present invention.
Figure 3:
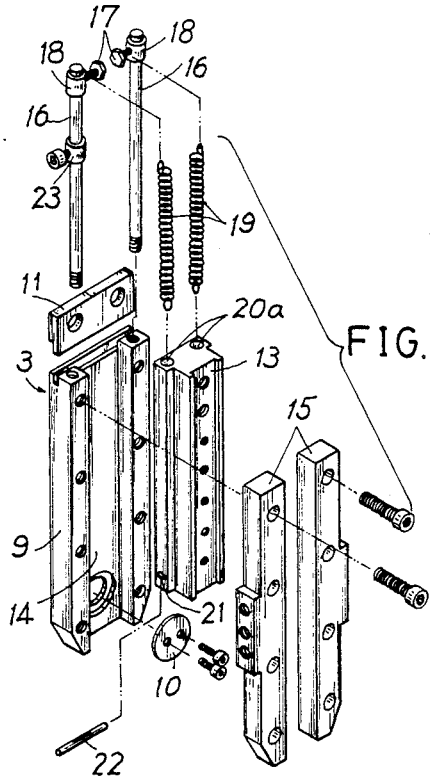
FIG. 3 shows an exploded view of the tool guiding means of the present invention.
Figure 7:
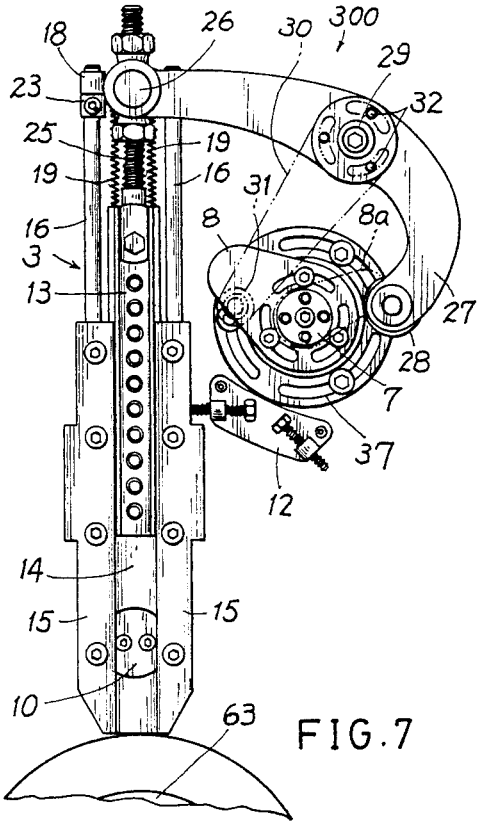
FIG. 7 shows the tool guiding means and the crank means of the present invention.

As shown in FIGS. 2 and 3, each of the eight sets of tool guiding means 3 includes: a slide base 9 adjustably pivotally secured on a fulcrum disk 10 mounted on a panel 20 of the gear box 2 and also firmly fixed on the panel 20 after setting the fixation position around the fulcrum disk 10 by means of the fixing plate 11 fixed on the panel 20, a positioning adjuster 12 provided by side of each guiding means 3 for adjusting the position or orientation of the guiding means 3 around the disk 10, a tool slide 13 slidably held in a longitudinal groove 14 of the slide base 9, two side plates 15 disposed on two sides of the slide base 9 to define the longitudinal groove 14 of the slide base 9, and two tension springs 19 each spring 19 having an inner spring end secured into a hole 20*a* formed in an upper portion of the tool slide 13 and having an outer spring end secured to a screw 17 having a collar 18 secured to a stem 16 fixed on the slide base 9 for normally pulling the slide 13 outwardly (or upwardly as shown in FIG. 7). A collar 23 is fixed on one stem 16 for limiting the outermost movement of the slide 13. The spring 19 after poking through the hole 20*a* is secured to a pin 22 transversely inserted in a lateral pin hole 21 as shown in FIG. 3.

Figure 4:
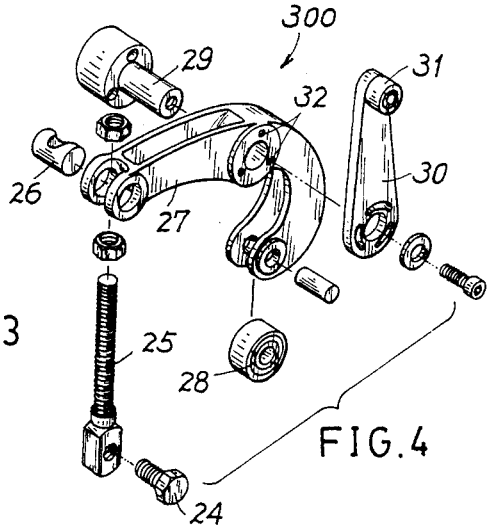
FIG. 4 shows a crank means for operating the forming tool of the present invention.

As shown in FIGS. 4 and 7, a crank means 300 of the present invention includes: a crank handle 27 pivotally secured on a central shaft 29 secured to the panel 20 by screws fixed in holes 32 having a first end of the handle 27 pivotally secured with a roller 28 operatively acted by a first cam 8 and having a second end pivotally secured with a side shaft 26 which is connected with an upper portion of a bolt 25 connected to the slide 13 by a screw 24, an auxiliary arm 30 also pivotally secured to the central shaft 29 having an outer arm end secured with a second roller 31 for operatively driving the second cam 8*a* (also shown in FIG. 6).

As shown in FIGS. 5 and 6, the gear box transmission system 2 includes: eight gears 33 radially disposed in the panel 20 of the gear box system 2 with every two neighbouring gears matching with each other, a driving motor 34 having a small gear 35 engaging one of the eight gears 33 for driving the gears 33, and a photo-sensed detector 36 sensing the rotation speed of the gear 33 which is transmitted to the microprocessor controller 4 for converting the rotation speed to a linear length data shown on a screen 4*a* of the controller 4 which controls the rotating speed and time period of the gear 33. Each gear 33 is connected with an eccentric wheel 37 adjustably secured on the panel 20 for matching the gears with one another by a gear shaft 7*a*, a cam disk 38 secured on a cam shaft 7 for securing the first cam 8 and the second cam 8*a* on the shaft 7 which is connected to the gear shaft 7*a* as shown in FIG. 6.

Upon a rotation of the gear 33 for driving the eccentric wheel 37, the cam disk 38 and the cams 8, 8*a*, the cam 8 or 8*a* will bias the roller 28 on the crank handle 27 to depress the roller 26 and bolt 25 in order to lower the slide 13, the tool holder 5 and the forming tool 6 for processing the spring as shown in arrow direction in FIG. 7. The spring 19 will restore the slide 19 outwardly.

Figure 9:
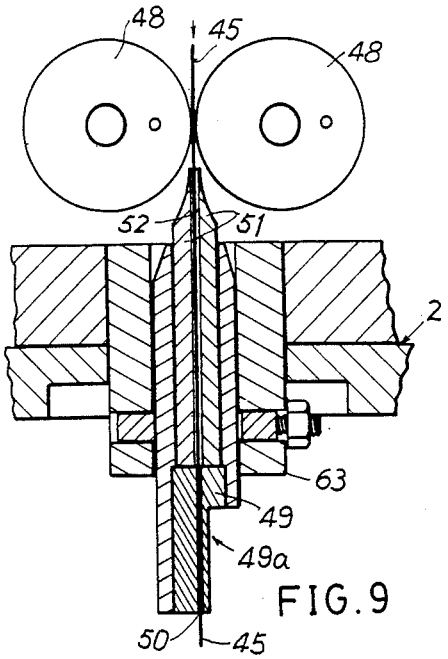
FIG. 9 is a top-view illustration showing the handling of the spring wire of the present invention.

The spring-wire feeding system 100 as shown in FIG. 8 includes: a variable-speed driving motor 39 connected with a main transmission shaft 41 by a coupling 40 which shaft 41 is mounted with a driving gear 42 thereon, a pair of feeding rollers 48 each secured on a feeding-roller shaft 43 of which a follower gear 44 is provided on a lower portion of the shaft 43 engageable with and driven by the driving gear 42, a tightness adjusting means 56 rotatably formed on the frame 1 for adjusting the aperture between the two feeding rollers 48 for firmly feeding the wire 45 including an adjusting rod 56*a* restored by a tension spring 55 and operatively moving a bearing block 54 rotatably secured with one shaft 43 and roller 48 with respect to the other shaft 43 and roller 48 for adjusting the aperture between the two rollers 48, a pair of idler sets 46 being perpendicular with each other for straightening the inlet wire 45 through a wire inlet guide 45*a* for feeding the wire 45 towards the two rollers 48 through a positioning device 47 formed before the rollers 48 and a chuck means 49*a* as shown in FIG. 9 including a pair of semi-circular guides 51 defining a wire passage 52 therebetween for passing the feeding wire 45 and a chuck 49 held in a chuck holder 63 fixed on the panel 20 for injecting the wire outwardly through an injection opening 50 to be processed by the tools 6. A photo-sensed detector 53 is provided under the shaft 43 for detecting the rotation speed of the shaft 43 and gear 44 which speed is converted to a linear length data to be shown on the screen 41 of controller 4 in order to control the rotation speed and running time period of the variable-speed motor 39.

As shown in FIG. 15, an auxiliary pneumatic controller 500 is provided in this invention including a mounting bracket 57 secured to the panel 20 through hole 58, and a tiny pneumatic cylinder 59 having a cylinder rod 60 connected with a probe 61 or with a guide bar 62 (not shown). The probe 61 is provided for precisely measuring the length of spring wire 45, whereas the guide bar 62 is provided for calibrating the orientation of the spring wire. The operation of the pneumatic cylinder 59 is controlled by the microprocessor controller 4 through a solenoid valve formed in frame 1 (not shown).

The spring wire 45 as controlled by the microprocessor controller 4 is injected outwardly through the opening 50 of the chuck 49 in a direction perpendicular to the plane of panel 20 of gear box 2 to be sequentially bent, curved and cut by the forming tools 6 respectively mounted on the holders 5 slidably moving in the plural guiding means 3 fixed on the panel 20. The controller 4 is provided for the memory of the sequence of processing steps of the plural tools 6, and for the control of continuous operation for making the springs. Each spring wire when injected to a specific length will be bent or curved to a coil spring, a spiral spring, a helical spring or any other springs, or wire portions having different orientations or shapes by the plural forming tools 6 of which each tool is driven by the cam 8 or 8*a*. One of the plural forming tools 6 is provided for cutting a finished spring product. Each tool 6 may be shaped at its processing end with a curve, a deflecting guide, a cutting edge or any other shaping guides.

Figure 12:
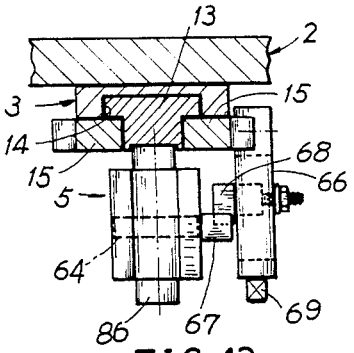
FIG. 12 is a top view of the tool guiding means of the present invention.
Figure 11:
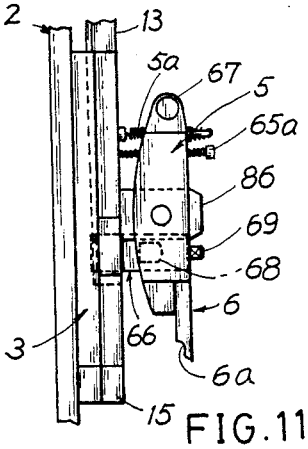
FIG. 11 is a side view of the tool guiding means and the tool of the present invention.
Figure 10:
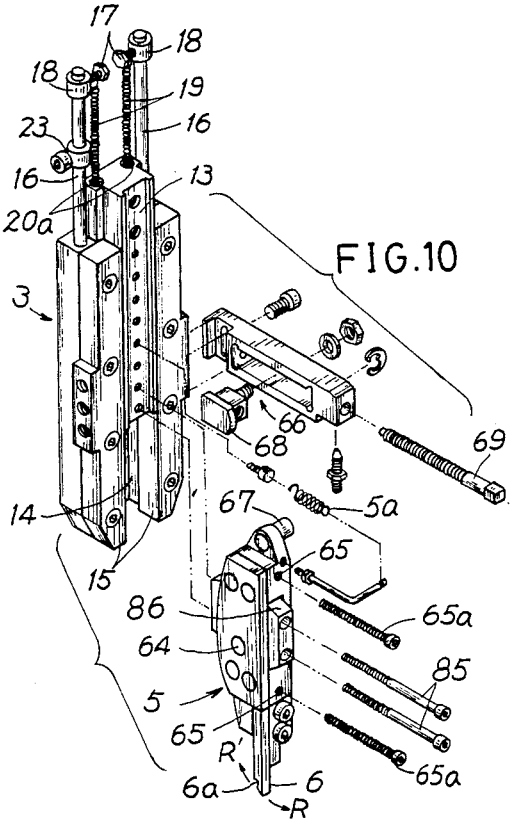
FIG. 10 is an exploded view showing the elements of the tool guiding means including a forming tool and its holder of the present invention.

As shown in FIGS. 10, 11 and 12, each forming tool 6 is secured on a forming-tool holder 5 which holder 5 is pivotally mounted by a pivot 64 on a supporting base 86 fixed on the slide 13 by screws 85. The tool holder 5 includes a biasing roller 67 secured on an outer portion (upper portion of FIG. 10) of the holder to be operatively biased to move the tool 6 frontwardly from the panel plane (direction R) when impacting the biasing block 68 adjustably secured on the biasing means 66 so as to gradually guide or deflect the spring wire along a processing edge 6*a* formed on the end of tool 6. The block 68 is adjusted on the biasing means 66 secured on the side plate 15 of slide base 9 by a screw 69. A bolt 65*a* is fixed on the tool holder 5 through hole 65 for limiting the biasing movement of the tool 6 and tool holder 5 as shown in FIG. 11. The holder 5 is restored by a spring 5*a* secured between the holder 5 and the slide base 9 for returning the tool 6 in direction R′ as shown in FIG. 10.

Figure 10A:
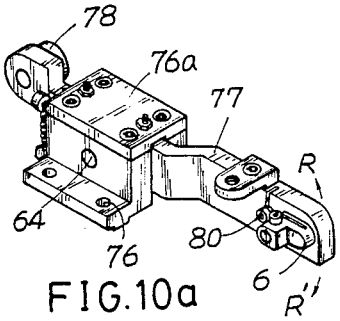
FIG. 10*a* shows another tool holder of the present invention.
Figure 10B:
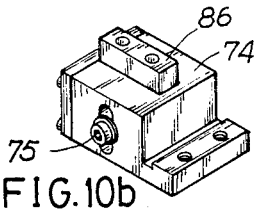
FIG. 10*b* shows still another tool holder of the present invention.

The tool holder 5 may be modified to be that as shown in FIGS. 10*a* or 10*b*. In FIG. 10*a*, the tool 6 is resiliently fixed on the tool body 77 by a spring 80 for forming U-shaped spring, which tool body 77 is pivotally secured by pivot 64 on the holder 76*a* mounted on slide 13 by screws fixed in holes 76, having a biasing roller 78 formed on an outer portion of the body 77 to be biased by the biasing block 68. In FIG. 10*b*, a fixed type tool holder 74 is mounted with tool (not shown) thereon and is pivotally secured to the supporting base 86 by a pivot 75.

Figure 13:
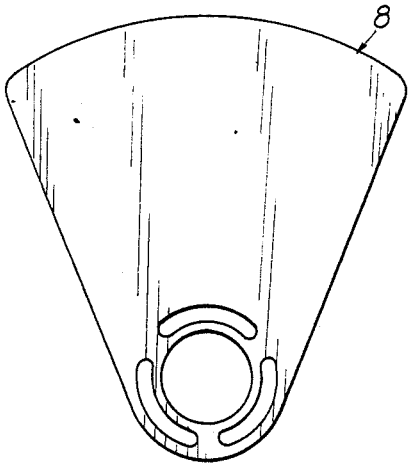
FIG. 13 shows a cam in accordance with the present invention.
Figure 13A:
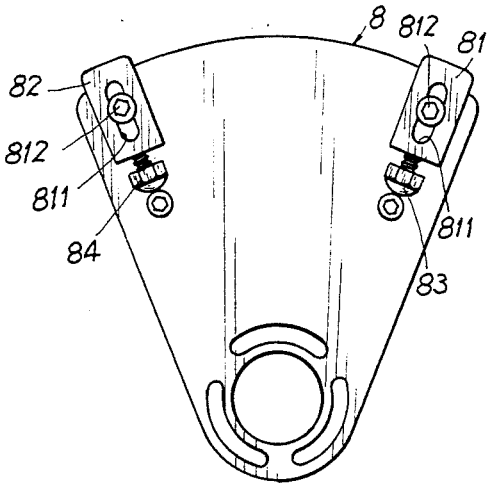
FIG. 13*a* shows another shape of the cam of the present invention.
Figure 13B:
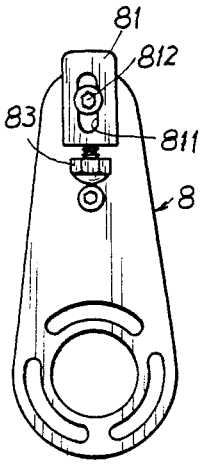
FIG. 13*b* shows still another cam of the present invention.
Figure 14:
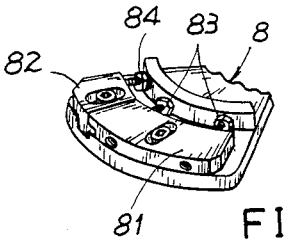
FIG. 14 shows further cam of the present invention.
Figure 14A:
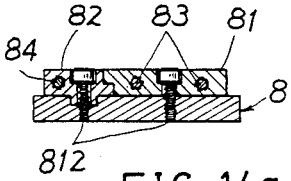
FIG. 14*a* is a side sectional view of the cam as shown in FIG. 14.

The cam 8 may be different shapes as shown in FIGS. 13, 13*a* and 13*b*. In FIG. 13*a*, two cam plates 81, 82 are respectively adjustably secured on the cam 8 by two screws 83, 84 for modifying the cam of the present invention. Each cam plate 81 or 82 is adjustably positioned on the cam 8 by moving the slot 811 formed in the plate along a locking screw 812. The cam 8 as shown in FIGS. 14, 14*a* includes two cam plates 81, 82 respectively adjusted by two screws 83, 84 radially protruding or retracting the plates 81, 82 on the cam 8 for further adjusting an outer edge of the cam 8 for processing special-purpose springs.

The shapes, styles and structures of the forming tools 6, tool holders 5 and cams 8, 8*a* are not limited in this invention which can be suitably modified to obtain different sliding strokes or processing times of the tool guiding means 3 to meet diversified processing requirements for making different springs.

The present invention has the following advantages superior to a conventional spring-making machine:

1. This universal machine can be used to produce springs directly on the machine without additional attachments for further cutting or bending operations so as to make differently-shaped springs more conveniently and efficiently. 2. A spring of multiple orientations can be easily made by the plural tools 6 and tool guiding means 3 radially disposed on the panel 20 perpendicular to a feeding wire 45 since all tools 6 are radially arranged on the panel 20 and each tool 6 may be radially reciprocated coplanar to the plane of panel 20 and also biased frontwardly or rearwardly perpendicular to the plane of panel 20 for freely deflecting, guiding and shaping the spring wire in multiple orientations and shapes.

3. The driving of gears 33 for sequentially operating the tools 6 for processing the springs, the feed control of the inlet wire 45, and the tool moving in multiple orientations can be smoothly controlled by the microprocessor controller 4 and the auxiliary pneumatic controller 500 for automatically making the springs in sound control situation.

I claim:

1. An automatic spring-making machine comprising:

a frame;

a gear box transmission system mounted on said frame having a plurality of gears driven by a first variable-speed driving motor and radially disposed on a panel of said gear box transmission system around a central chuck for feeding spring wire therethrough;

a plurality of sets of tool guiding means radially disposed on said panel of said gear box transmission system for radially sliding a plurality of forming tools as driven by said gear box transmission system through a plurality of sets of crank means;

each said crank means including: a crank handle pivotally mounted on a central shaft fixed on said panel having a first handle end rotatably mounted with a crank roller operatively biased by a cam fixed on a cam disk secured to a gear shaft of said gear of the gear box transmissiqon system, and having the other handle end rotatably mounted with a side shaft connected with a bolt secured to said slide of said tool guiding means, whereby upon a rotation of said gear to rotate said cam, said cam roller will be biased to let said side shaft acting said bolt and said slide for radially moving said forming tool for processing the spring;

a spring-wire feeding system having at least a pair of feeding rollers driven by a second variable-speed driving motor for feeding a spring wire through a chuck formed in a center portion of said panel protruding frontwardly and perpendicular to said panel and injecting the spring wire frontwardly from the chuck to be processed by said forming tools, said spring wire being fed in a direction towards said chuck perpendicular to a plane of said panel of said gear box transmission system;

a microprocessor controller respectively sensing the rotation speed of said first motor of said gear box transmission system and said second motor of said spring-wire feeding system and respectively converting the rotation speed of said motors into a linear length data shown on a screen on said controller, and operatively controlling the rotation speed and running time of both said motors, said microprocessor controller including a first photo-sensed detector for sensing a rotation speed of said first driving motor of said gear box transmission system, and a second photo-sensed detector for sensing a rotation speed of said second driving motor of said spring-wire feeding system; and at least an auxiliary pneumatic controller having a pneumatic motor and a cylinder rod provided with a probe thereon for measuring a length of a spring product, the improvement which comprises:

said tool guiding means including a slide base pivotally secured on said panel, a tool slide slidably held and radially moving in a longitudinal groove formed in said slide base, said slide normally restored by at least a tension spring secured between said slide and said slide base, a forming tool holder having the forming tool secured on one end portion of said holder pivotally secured on a supporting base secured to said slide, said tool holder and said forming tool pivotally biased frontwardly and backwardly generally perpendicular to a plane of said panel of said gear box transmission system; and said forming-tool holder including a biasing roller formed on an outer portion thereof to be operatively impacted by a biasing block formed on a side portion of said tool guiding means for biasing the tool holder and the tool frontwardly from said panel of said gear box transmission system for gradually guiding or deflecting the spring wire into a desired orientation or shape, whereby upon a feeding of a spring wire through said feeding system and upon a rotation of said driving motors, the spring wire will be sequentially curved, bent, and cut by said plurality of forming tools each tool radially moving in said tool guiding means as controlled by said microprocessor controller and said auxiliary pneumatic controller.

2. An automatic spring-making machine according to claim 1, wherein the improvement further comprises said gear of said gear box transmission system which is connected with an eccentric wheel eccentrically adjustably fixed on said panel for matching all said gears of said gear box transmission system with on another so that said first driving gear may drive any one said gear in order to drive all the gears.

3. An automatic spring-making machine according to claim 1, wherein the improvement further comprises said crank means having an auxiliary arm pivotally secured to said central shaft having a second crank roller pivotally secured on an outer end of said arm to be operatively biased by a second cam secured to said cam disk connected to said gear.

4. An automatic spring-making machine according to claim 1, wherein the improvement further comprises said cam for biasing said crank handle having at least a cam plate adjustably formed on a cam edge of said cam.

* * * * *